US006993898B2

(12) United States Patent
Parkin

(10) Patent No.: US 6,993,898 B2
(45) Date of Patent: Feb. 7, 2006

(54) MICROWAVE HEAT-EXCHANGE THRUSTER AND METHOD OF OPERATING THE SAME

(75) Inventor: Kevin Parkin, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 175 days.

(21) Appl. No.: 10/614,645

(22) Filed: Jul. 7, 2003

(65) Prior Publication Data

US 2004/0139723 A1 Jul. 22, 2004

Related U.S. Application Data

(60) Provisional application No. 60/394,473, filed on Jul. 8, 2002.

(51) Int. Cl.
*F03H 5/00* (2006.01)

(52) U.S. Cl. ..... 60/203.1; 244/62

(58) Field of Classification Search ..... 60/200.1, 60/202, 203.1; 244/62, 73 R
See application file for complete search history.

(56) References Cited

U.S. PATENT DOCUMENTS 3,083,528 A * 4/1963 Brown ..... 60/203.1
3,206,925 A * 9/1965 Schiff ..... 60/203.1
3,891,160 A * 6/1975 Minovitch ..... 244/62
5,503,350 A * 4/1996 Foote ..... 244/62

* cited by examiner

*Primary Examiner*—Louis J. Casaregola
(74) *Attorney, Agent, or Firm*—Daniel L. Dawes; Myers Dawes Andras & Sherman

(57) ABSTRACT

A propulsion system is disclosed that uses microwaves originating from a ground-based or on-board source to provide energy for propulsion. The energy produces thrust by coupling into a propellant via a microwave absorbent heat exchanger, and by subsequent conversion of the propellant thermal energy to kinetic energy through a thrust converter or nozzle.

19 Claims, 4 Drawing Sheets

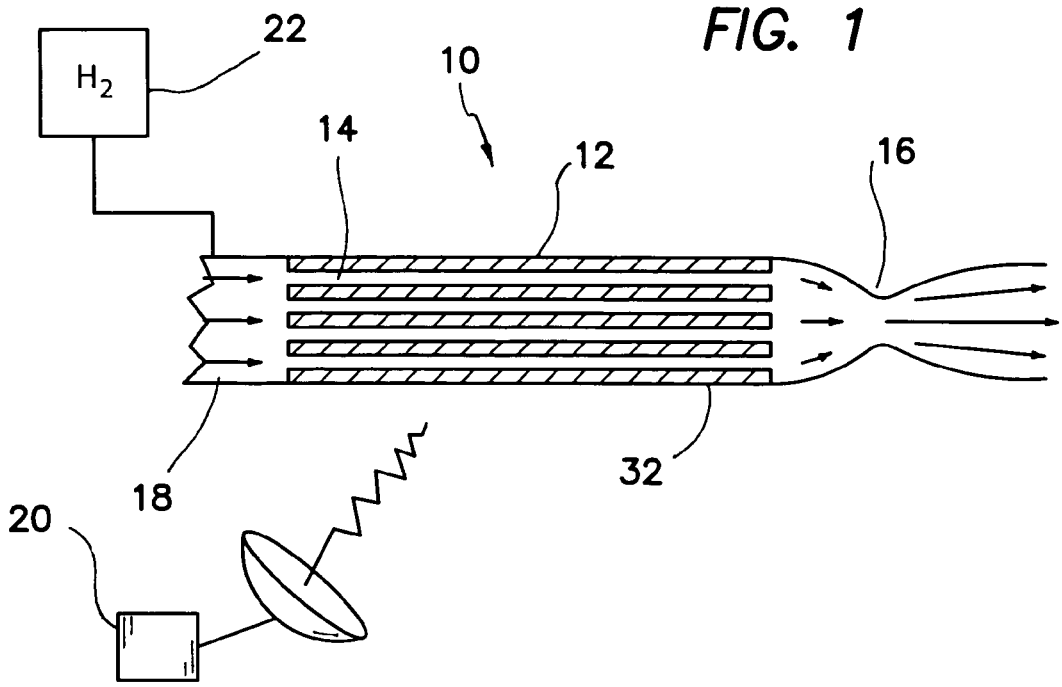
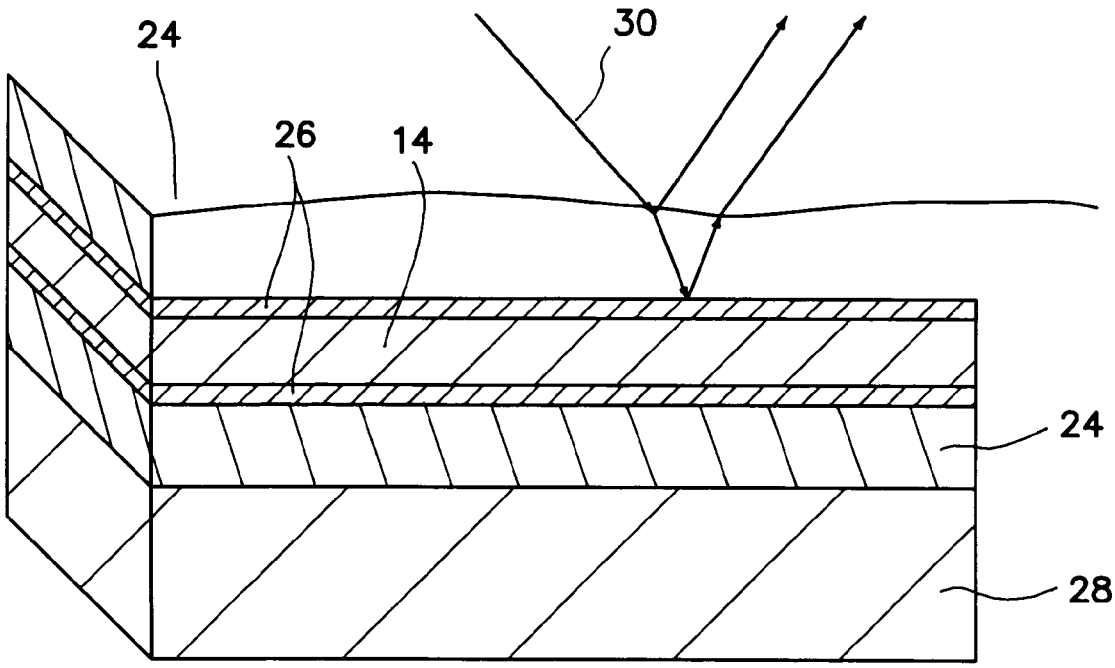
FIG. 2

MICROWAVE HEAT-EXCHANGE THRUSTER AND METHOD OF OPERATING THE SAME

RELATED APPLICATIONS

The present application is related to U.S. Provisional Patent Application Ser. No. 60/394,473, filed on Jul. 8, 2002, which is incorporated herein by reference and to which priority is claimed pursuant to 35 USC 119.

BACKGROUND OF THE INVENTION

1. Field of the Invention

The invention relates to a thruster that uses microwaves, from a ground-based or on-board source, to provide energy for propulsion.

2. Description of the Prior Art

Wireless power transmission within and outside the atmosphere is reviewed in the article by William C. Brown; *Beamed Microwave Power And Its Application To Space*, IEEE Transactions on Microwave Theory and Techniques Vol. 40 No. 6 (1992). The high power microwave aspect is detailed by J. Benford and J. Swegle; *High-Power Microwaves*. Artech House (1992).

The propulsion system generates thrust using microwave energy-addition to a propellant via a heat exchanger. Heat exchangers are discussed generally by O. Levenspiel; Engineering Flow and Heat Exchange, and in the context of nuclear rockets by Turchi; *Propulsion Techniques, Action and Reaction*. AIAA (1998). Nuclear thermal rockets, simple ascent trajectory modeling, and methods of thermodynamic nozzle design, are presented in the classic text by G. P. Sutton; Rocket Propulsion Elements. For the case of airbreathing propulsion, this open-cycle thermodynamic process is described by Mattingly; *Elements of Gas Turbine Propulsion*. The design of ground based microwave energy sources for rocket propulsion is described in J. Benford et. al., "Space Propulsion and Power Beaming Using Millimeter Systems," in H. Brandt ed., Intense Microwave Pulses III, SPIE 2557, 179 (1995); and in Benford et. al. "Propulsion of Small Launch Vehicles Using High Power Millimeter Waves," Intense Microwave Pulses II, SPIE 2154, 198 (1994).

High power microwave breakdown of gases, for example in $H_2$ and air, can be a limiting factor in some aspects of design. Breakdown of this kind is explained by J. M. Meek & J. D. Craggs; Electrical Breakdown of Gases.

A recent overview of the present art in microwave-material interactions for heating, including references, is given by the National Research Council; Microwave Processing of Materials. The field of microwave materials processing shares common disciplines with microwave heat-exchange thruster design. In particular, it shares absorption physics and experimental, analytical, and computational techniques for the design of microwave absorbing structures. The microwave absorbing structure itself will necessarily be constructed of refractory materials, which are treated in an engineering context by H. O. Pierson; Handbook of Refractory Carbides and Nitrides: Properties, Characteristics, Processing and Applications (1996).

Some types of microwave and laser propelled rocket engines have been proposed in the past. In these engines, a high power microwave or laser beam is directed at the launch vehicle to be captured and focused onto a suitable working fluid, such as hydrogen. The working fluid is thereby heated to very high temperatures and expelled from a conventional rocket nozzle with exhaust velocities significantly higher than those obtainable with chemical rocket engines. (See for example, the papers: "Microwave Rocket Concept," International Astronautical Congress, Vol. 16, Athens, 1965, pp. 175–199 by J. L. Schad and J. J. Moriarty; and "NASA's Laser Propulsion Project," Astronautics & Aeronautics, September 1982, pp. 66–73 by L. W. Jones and D. R. Keefer.) Unfortunately, all of these attempts at circumventing the initial mass problem have failed by a wide margin. Thus, it was subsequently believed that reusable single stage to orbit (SSTO) vehicles propelled by chemical rocket engines would be the most economical transportation system for launching manned vehicles to low Earth orbit (See, "The Future Space Transportation Systems Study," Astronautics & Aeronautics, June 1983.). At present, the failed development of Venture Star, an SSTO launcher, has led to renewed interest in two stage to orbit (TSTO) vehicles. (See for example, "Integrated Space Transportation Plan", NASA, 2002).

Although microwave and laser propelled launch vehicles were found to be technically heretofore impractical for launching manned space vehicles, they had one common and very important characteristic: the energy generating mechanism used to accelerate the vehicle is located off the vehicle. Thus, the amount of energy that can be used to accelerate the vehicle is limited only by the physics of energy transmission from source to vehicle. Moreover, since the energy source is physically removed from the vehicle, the vehicle is not burdened by having to accelerate its inertial mass. In principle, the combination of these two operating characteristics has the potential of giving a "tele-propelled" vehicle of very high performance.

Minovitch, "*Electromagnetic Transportation System for Manned Space Travel*," U.S. Pat. No. 4,795,113 (1989) describes an exotic electromagnetically propelled space transportation system in which the launch vehicle is equipped with a plurality of superconducting propulsion coils extending along the fuselage and is accelerated to orbital velocities inside a vacuum tube by a 1,530 km long electromagnetic linear accelerator. The vacuum tube is evacuated by utilizing the accelerator as a giant vacuum pump wherein a free-moving, magnetically propelled, air-tight piston is driven through the entire tube at low speed thereby forcing the air directly out the end. The accelerator is embedded deep underground with a maximum depth of 46 km and emerges near the summit of a high mountain. The system is powered by the Earth's gravitational field whereby natural hydro and geothermal energy is converted into electrical energy.

Besides having a conventional chemical rocket engine, the Minovitch space propulsion system includes six high power electron cyclotron resonance plasma engines mounted around the central rocket nozzle. Each of these electromagnetic engines are 1.5 m (4.92 ft) in diameter and generate an effective propulsive power of 5 MW. The plasma engines use argon or nitrogen propellant. The electric power source used to operate the plasma engines is derived from the thousands of high field superconducting vehicle propulsion coils and superconducting magnetic shielding coils mounted inside the vehicle's pressure hull. Thus, the propulsion coils are not only used to launch the vehicle from Earth by magnetic forces between the drive coils of the electromagnetic accelerator but also as inductive energy storage systems for operating the vehicle's plasma accelerator engines, for auxiliary space propulsion as well. The DC electric current is extracted from the superconducting coils via the electrical systems and fed into high efficiency Magnetron or Amplitron microwave generators located in the rear section of the vehicle. The microwaves are fed into a system of high power waveguides leading into the plasma accelerators. The detailed design, construction and operating principles of these high power engines (using superconducting drive coils) can be found in "Solar Powered, Self-Refueling, Microwave Propelled Interorbital Transportation System," AIAA 18th Thermophysics Conference, Jun. 1–3, 1983, Montreal, Canada, AIAA paper No. 83–1446 by M. A. Minovitch.

BRIEF SUMMARY OF THE INVENTION

The invention is defined as a thruster comprising a source of propellant; a source of microwave energy; a heat exchanger for receiving energy from the source of microwave energy, which heat exchanger is thermally coupled to a propellant flow originating from the propellant source; and a thrust converter coupled to the heated propellant flow to generate thrust.

In the preferred embodiment, the source of propellant comprises a source of hydrogen, and in the case of air-breathing operation comprises ambient atmosphere, or both. Where the source of propellant comprises ambient atmosphere and an onboard propellant, the propellant, if combustible, is combusted with the atmospheric air to release additional energy added to that from the source of microwave energy and delivered to the thrust converter.

The heat exchanger comprises a microwave absorber which is thermally coupled to the propellant supplied from the source of propellant and electromagnetically coupled to the source of microwave energy. In one embodiment the microwave absorber comprises a lossy dielectric structure. In another embodiment, the microwave absorber comprises a susceptor.

In the illustrated embodiment the source of microwave energy comprises an earth-bound source of microwave energy, or comprises a space-bound source of microwave energy.

The invention is also a method comprising the steps of providing propellant; providing microwave energy; absorbing the microwave energy; transferring the absorbed energy to the propellant; and converting the energized propellant into thrust.

Again, the step of providing propellant comprises providing hydrogen, ambient atmosphere, or both. Where the step of providing propellant comprises providing ambient atmosphere and an onboard propellant, the propellant, if combustible, is combusted with the atmospheric air to release additional energy added to that from the source of microwave energy and delivered to the thrust converter.

The step of absorbing the microwave energy comprises electromagnetically coupling a heat exchanger with a source of microwave energy. The step of transferring the absorbed energy to the propellant comprises transferring the absorbed microwave energy to the propellant supplied by means of a flow heat exchanger. In one embodiment the step of absorbing the microwave energy comprises absorbing the microwave energy in a lossy dielectric structure, while in another embodiment the step of absorbing the microwave energy comprises absorbing the microwave energy in a susceptor.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The invention can be better visualized by turning now to the following drawings wherein like elements are referenced by like numerals.

BRIEF DESCRIPTION OF THE DRAWINGS

FIG. 1 is a diagrammatic side view of a thruster using the principle of the invention.

FIG. 2 is a simplified diagram of one embodiment of a heat exchanger consistent with the principles of the invention using a microwave susceptor.

The invention and its various embodiments can be better understood in the following detailed description of the preferred embodiments, presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 3:
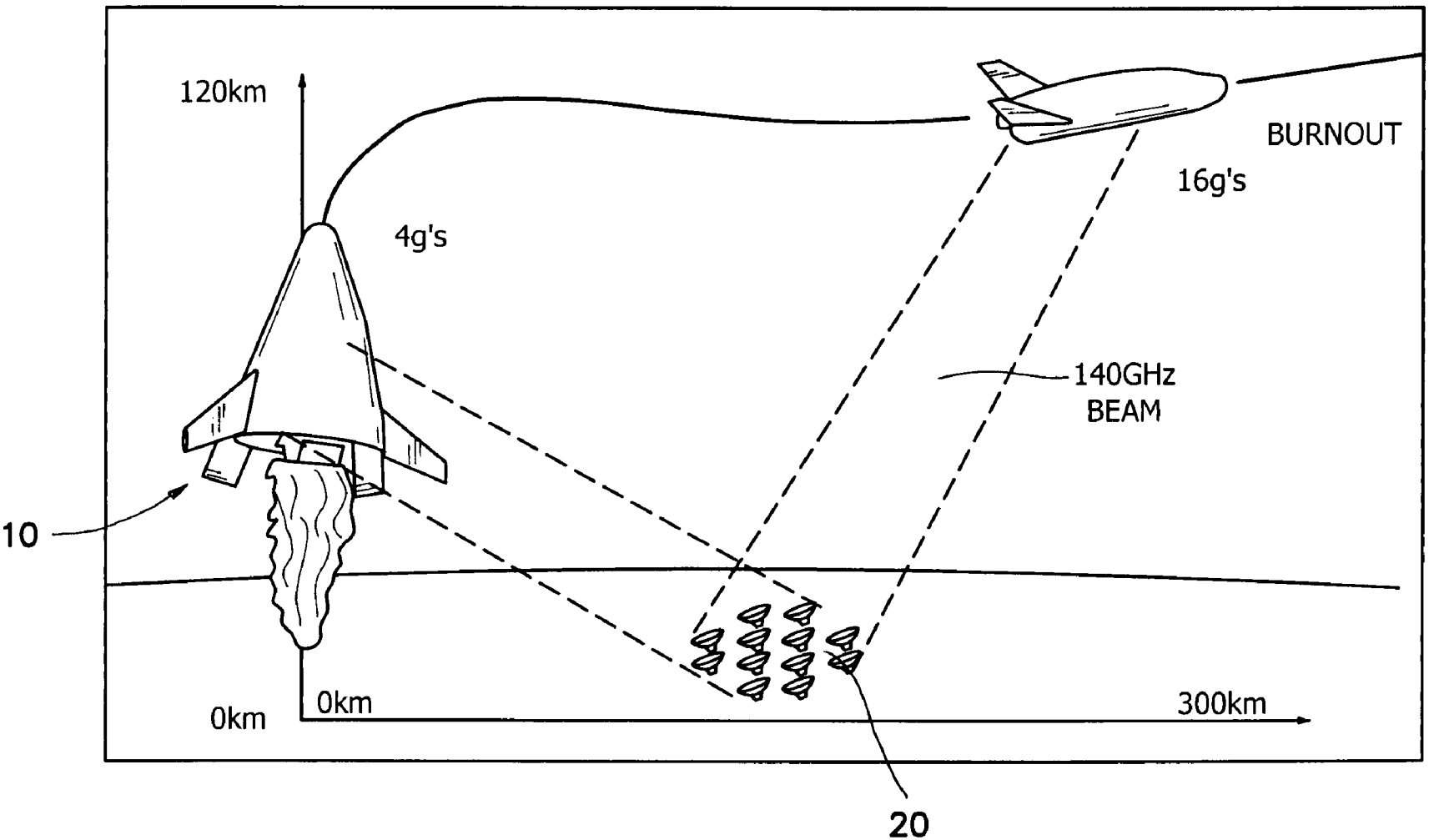
FIG. 3 is a diagrammatic depiction of the entire system and ascent trajectory using an earth bound microwave power source.

The invention is a propulsion system that uses microwaves, from a ground-based or on-board source, to provide energy for propulsion. FIG. 3 shows a vehicle 10 being targeted by an array 20 of microwave power sources receiving the energy and being tracked by the power source as it lifts off and travels down range. Vehicle 10 has a flattened belly which serves as a microwave absorbing cross-section and also is usable for aerodynamic effect as part of the aeroshell or "air" frame, and for thermal effect as part of the atmospheric re-entry heat shield. A source of cooling fluid, such as excess liquid hydrogen or other on board stored cooling fluid on board the vehicle can be used as a cooling fluid to be circulated through the heat exchanger when used as a heat shield. The use of a winged or lifting-body aeroshell provides greater re-entry cross-range, resulting in a larger choice of landing sites and general robustness of the launch system.

Energy is exchanged into a propellant, such as molecular hydrogen, ammonia, ethyl alcohol, or propane, via a heat-exchanger constructed with microwave absorbent materials, for example either susceptor materials of the kind used in some microwave food packaging or lossy dielectric absorbers, or some combination of the two. Microwave energy absorbed in the heat exchanger heats the propellant, which is then expelled through a nozzle to produce thrust in a conventional manner. The heat exchanger 12 may be comprised of a solid block 32 of moderately lossy dielectric through which a plurality of channels 14 in the form of closely spaced tubes are defined, or for a more heavily lossy dielectric, the block has very shallow depth of only a few centimeters and one channel deep. In effect, it becomes a surface absorbing structure, rather than a volume absorbing structure. This simplifies the design of a craft in that it occupies a large, flat, area of the outer surface rather than volume within, requires no high power microwaves to be channeled within the craft, no reflecting or focusing structures protruding from the craft, and could possibly be vapor deposited directly on the outside. When a susceptor is used, heat exchanger 12 can again be a volumetric or surface absorbing structure which has a sheet-like channel 14 defined through or between susceptor layers 26, which in turn are clad with one or more dielectric and reflecting layers 24, 28 configured to maximize power absorption in the susceptor layer 26.

Susceptors are thin layers of poorly conducting metals or semiconductors. They are well known to the food packaging art, the absorption, reflection and transmission characteristics of which susceptors are derivable from first principles, such as shown by Buffler, "A Simple Approach to the Calculation of Microwave Absorption, Transmission and Reflection of Microwaves from a Susceptor Film," Microwave World, Vol. 12, no. 3, page 5 et.seq. (1991). The performance of a susceptor layer is optimized in the invention by tailoring the material properties at the operating temperature, and the thickness of the layer as well as its surrounding layers. The article by Buffler referenced above gives a simplified sense of how to determine optimal susceptor thickness by equivalent circuit analysis. A more detailed analysis can be made by stratified layer calculation using an analytical solution of the Maxwell's equations through the absorbing structure. This approach is described in the classic text, Principles of Optics by Born and Wolf. Alternatively, a finite element or finite difference time domain (FDTD) simulation can be used to optimize more complex structures such as shown in FIG. 2.

In both cases, material properties and hence efficiency of the susceptor arrangement, will vary considerably with temperature. This can be dealt with in several ways: (a) The absorbing structure of the susceptor is designed with portions that absorb strongly at different temperatures, such as by varying susceptor thickness along the length of the hydrogen channel 14 in the heat exchanger 12; or (b) Using some other means, for example infra-red radiation, to preheat the absorbing structure in the heat exchanger 12 to minimum operating temperature; or (c) The frequency of the microwave source is varied to maximize the power transfer to the absorbing structure as overall temperature varies, and can be varied or 'swept' through a range of frequencies to produce a more even temperature throughout the absorbing structure when in steady thermal state operation. In the preferred embodiment the susceptor structure of FIG. 2 is designed to operate at the maximum of its power absorption fraction. This means any defects in the structure reduce the thermal load of that area rather than increasing it. This is the opposite of what happens in high power laser mirrors, for example. A minute defect in a laser mirror can lead to a region of plasma that absorbs more strongly as it grows, leading to spreading damage that degrades the mirror surface.

FIG. 2 is a side cross-sectional perspective view of one embodiment of the susceptor structure used to form a skin around $H_2$ channels 14 in heat exchanger 12. $H_2$ channels are formed within a dielectric, and the inside of the channels are coated with a thin a susceptor layer. Ideally, the susceptor layer is an ultra-refractory alloy, such as HfC or TaC, both of which have melting points exceeding 4000 K. For thin susceptor layers, absorptivity depends upon the product of conductivity and thickness ($\sigma t$), hence, a higher conductivity means a thinner susceptor layer for the same absorptivity. Both HfC and TaC can suffer from this problem, therefore, materials selection and property modification should be such that the susceptor is not so thin that within the operational life of the thruster, which may only be minutes, the susceptor does not overly diffuse into the surrounding dielectric, evaporate into the propellant, or erode due to micro-particulate abrasion from the propellant flow. Suitable high temperature dielectrics include boron nitride (BN), which is usually microwave transparent and has a melting temperature of about 3000 K. Behind the dielectric/susceptor sandwich surrounding $H_2$ channels 14 is a metallic or conductive reflector layer 28. In the preferred embodiment as shown in FIG. 2 a dielectric layer 24 is disposed on the susceptor surface 26 facing the incoming microwaves 30 and is used as an anti-reflection coating. By doing this, the maximum power absorption fraction of a thin susceptor layer 26 is raised from about 50% to about 75%.

Heat exchanger technology has been developed for application to nuclear rockets, and therefore provides a general prior art for rocket engines that readily translates to application on the invention where microwave absorbers replace the heat source of nuclear heated fluids. See for example, Culver, "*Nuclear Rocket Engine Incorporating Heat Exchange*," U.S. Pat. No. 5,873,329 (1999), assigned to Aerojet General Corp. As in the nuclear case, temperature limitations of the heat exchanger materials will limit the practical specific impulse of the device. Having said that, material constraints mean that the temperature limit would be the same as any other heat-exchanger based concept, and therefore the specific impulse would rival that of a nuclear rocket >(>700 sec). In contrast to nuclear rockets, where heat exchange from the neutron gas to hydrogen propellant occurs within a volume, microwave heat exchange with an incident beam can be performed within a thin surface intersecting the beam.

Several factors need to be considered in the design of heat exchanger 12. Thermally induced stresses between material layers in heat exchanger 12 can be addressed by segmenting the layers or matching thermal expansion coefficients between materials.

The breakdown of hydrogen into a plasma within the channel 14 could erode the inner surface of channel 14. In proper or ideal operation most of the microwaves should be absorbed before they reach channel 14. Hydrogen breakdown can be prevented by keeping the hydrogen density sufficiently high.

The conductivity of hydrogen also changes along the length of channel 14 as the hydrogen heats. The hydrogen starts from approximately room temp at one end of the channel 14 and ends up at several thousand degrees Kelvin at the other, so the conductivity changes along the length of channel 14. Conductivity somewhat affects microwave propagation through a susceptor layer near channel 14 because it changes the refractive index of the hydrogen flow as seen by the microwaves.

The materials used in heat exchanger 12 are chosen according to well understood principles of chemical resistance to the reducing atmosphere of hydrogen.

An interface of two materials can sometimes have a lower melting point than either of the bulk materials. Hence, the choice of materials must be made with consideration given to melting points of material interfaces in heat exchanger 12.

The material of heat exchanger 12 should have a robust thermal shock resistance. Boron nitride has excellent thermal shock resistance, microwave transparent, a good conductor, and melts at ~3000 K.

The choice of materials must be made so that the solids chosen aren't soluble within each other through the range of temperatures and pressures used in heat exchanger 12.

When instead of a susceptor structure as shown in FIG. 3, channels 14 are simply provided as tubes in a solid block of ceramic or other lossy dielectric, the thermal stress problems that could be encountered with the layered susceptor approach are avoided. However, the lossy dielectric must be chosen to have optical properties selected for an optimal energy absorption fraction. This can be calculated according to principles well known in the art using a stratified layer or finite difference time domain (FDTD) approach with suitable bulk material properties. Bulk material properties of course vary with temperature. Suitable materials can be selected by using techniques common to the art of microwave sintering or microwave materials processing, which address these kinds of issues for both lossy dielectrics and susceptors of various ceramics and metals.

The thermal energy transferred into the propellant in the heat exchanger 12 is converted by the thrust converter/nozzle to kinetic energy to provide high exit velocity, and hence a high specific impulse. Conceivably, this could be achieved by many means, but in the preferred embodiment is achieved by a Plug nozzle, Laval nozzle or equivalent. As a rough example, if the flow from the heat exchanger were expanded to vacuum through an ideal choked nozzle, and approximating the fluid heat capacity to remain constant throughout this process, the specific impulse is described by $$I_{SP} = \frac{\sqrt{2C_p T_{0d}}}{g}$$

where $I_{SP}$ is the specific impulse, $c_P$ is the specific heat capacity of the propellant, $T_{0h}$ is the stagnation temperature of the propulsion reservoir, and g is the terrestrial gravitational constant used as a normalization factor. For a stagnation temperature of 2000 K at the heat exchanger, and a molecular hydrogen propellant $c_p$ of 17000 J/(kg.K), the corresponding specific impulse is 840 seconds.

Figure 4:
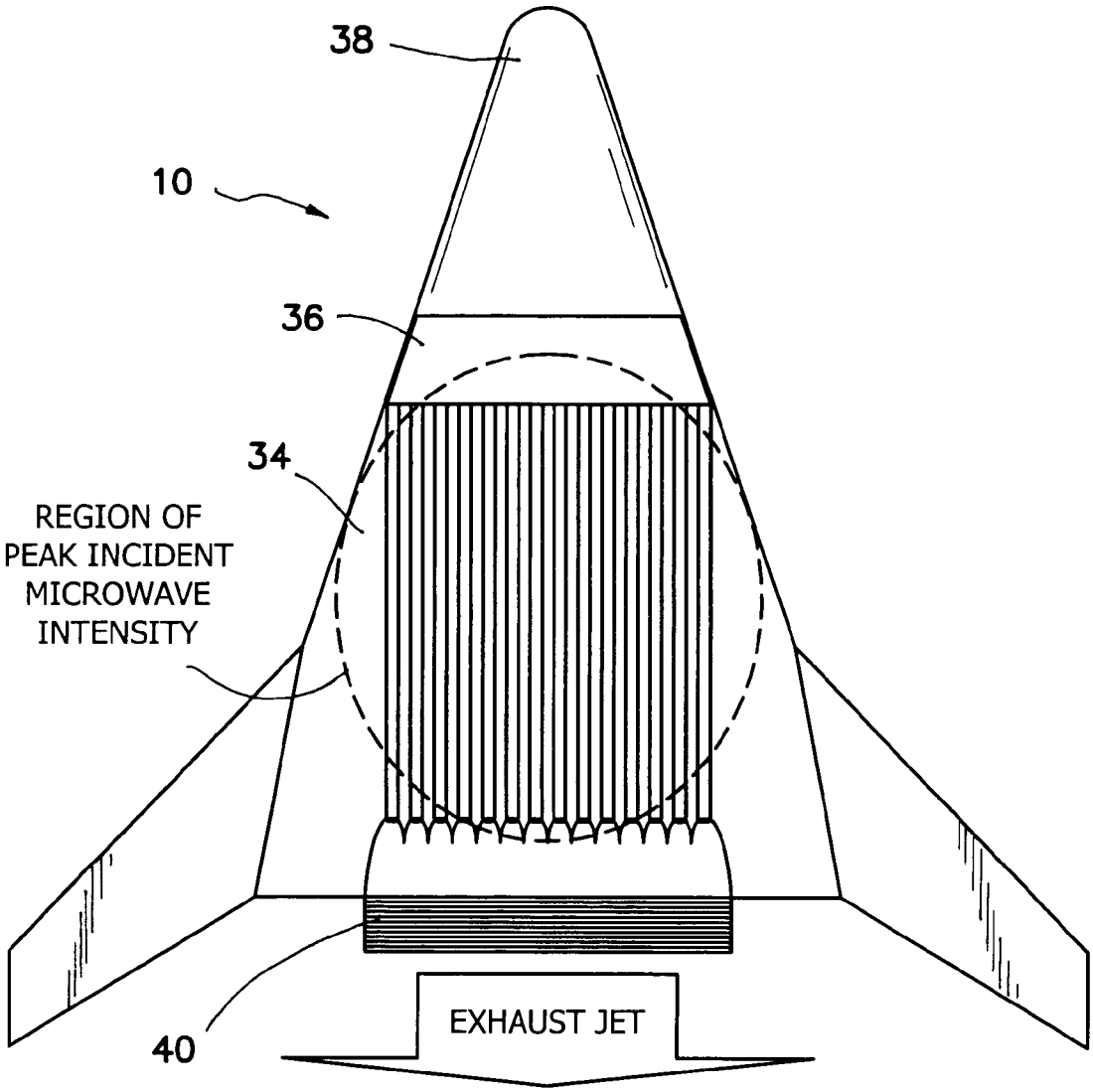
FIG. 4 is a diagrammatic depiction of the launch vehicle as seen from a bottom plan view.
Figure 5:
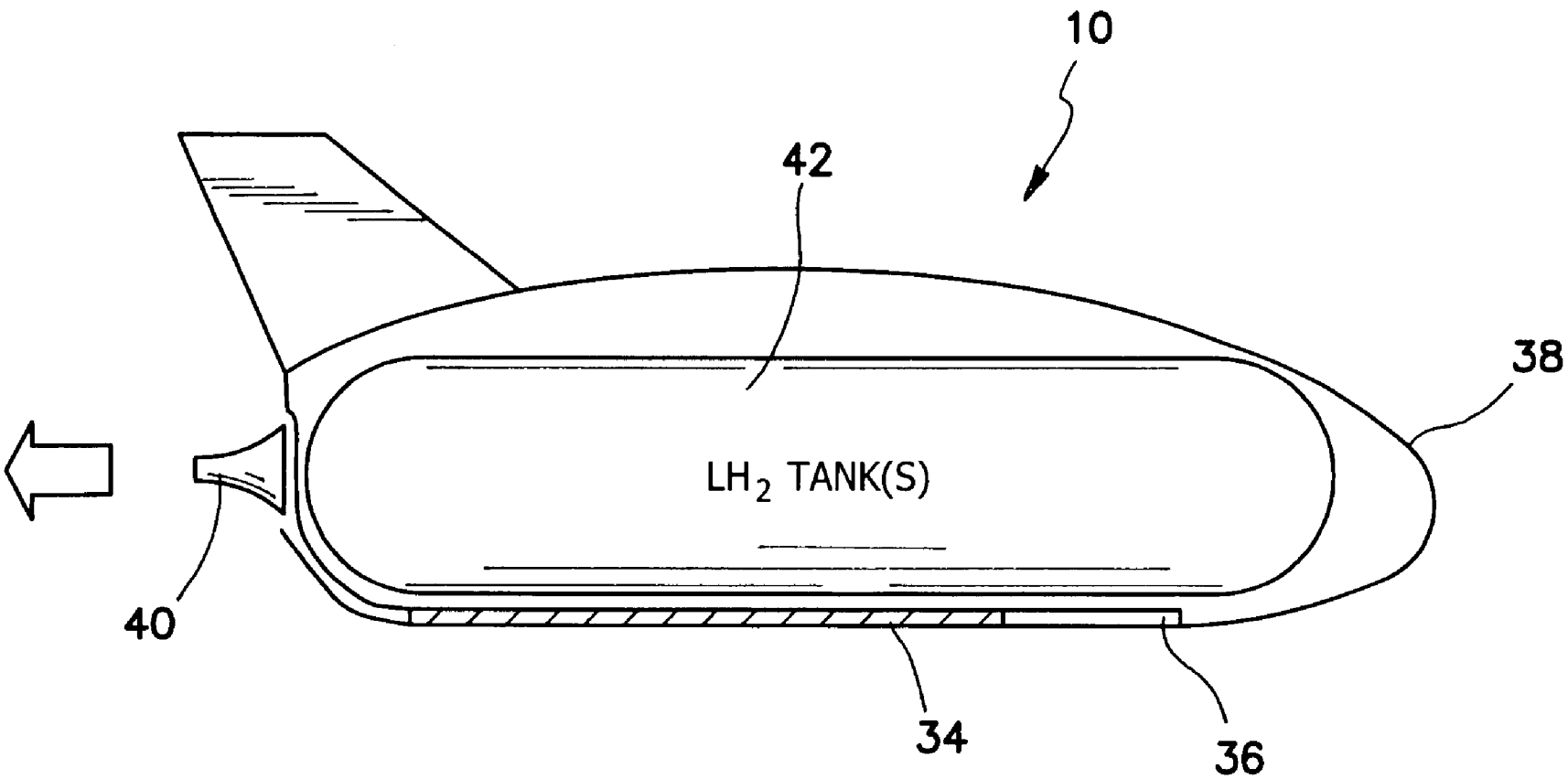
FIG. 5 is a diagrammatic depiction of a side view of the launch vehicle of FIG. 4.

In the preferred embodiment of FIGS. 4 and 5 vehicle 10 is shown in plan bottom view in FIG. 4 in which aeroshell 38 presents a microwave or electromagnetic absorbing surface or region 34 through which a plurality of parallel channels 14 are defined from a 300 K high pressure header or feeder 36 of $H_2$ to the thrust converter or in this embodiment, plug nozzle 36. Electromagnetic absorbing surface or region 34 may be a volume or surface absorbing region of the types disclosed. The side cross-sectional view of FIG. 5 shows high pressure header or feeder 36 coupled to the larger liquid hydrogen supply tank 42. Energy from absorbing surface or region 34 or other conventional energy source carried on board is transferred to the liquid hydrogen to bring it from the liquid state to an approximately 300 K gas form in feeder 36 by conventional means. Preferably and regardless of the nature of the electromagnetic energy absorption in surface or region 34, surface or region 34 is relatively flat, typically about 3 cm thick.

In another embodiment, shown in diagrammatic side view in FIG. 1, a rocket thruster, generally denoted by reference numeral 10, uses hydrogen as a propellant which is passed through a microwave absorbent heat-exchanger 12 containing a plurality of propellant channels 14, a Laval nozzle 16, and regenerative cooling system (not shown). Hydrogen gas is drawn from a reservoir 22 under pressure which is onboard the vehicle 10. The regenerative cooling system is not material to the invention and provides cooling of the nozzle 16 using propellant prior to its heating in exchanger 12.

An air-breathing variant of the thruster 10 of FIG. 1 is also possible, whereby air is slowed and compressed by a diffuser stage 18 such that it can be passed through the heat exchanger 12. In other words, where air is present, it can be slowed from what would be supersonic velocities, assuming the rocket to be traveling at supersonic velocities, and mixed with the hydrogen propellant for injection into heat exchanger 12 and possibly combusted. Whether or not combustion occurs again is not material to the invention which uses the microwave absorption in exchanger 10 as the primary means of energy addition to the propellant, whether it be air, hydrogen or some combination of the two or any other propellant medium. It is also conceivable that, at this stage of operation, hydrogen may not be provided and only air would be ingested by thruster 10.

In both embodiments, the source 20 of microwaves is a plurality of earth bound magnetrons, gyrotrons, or other conventional microwave power sources focused on heat exchanger 12. Heat exchanger 12 thus comprises any form of microwave absorbing structure now known or later devised. Thus, heat exchanger 12 may include a separate structure for absorbing microwaves thermally connected or coupled to a thermal heat exchanging structure, or the heat exchanging structure and microwave absorbing structure may be integral with each other. For example, one enabled form of the heat exchanger 12 is shown in FIG. 1 where a solid block 32 comprised of a microwave absorbing ceramic with a plurality of parallel, 3 mm diameter, hydrogen channels 14 or tubes are defined through it. The diagram and structure is analogous to that of the Nerva nuclear rocket. Microwaves permeate the block 32, and whether or not the channels 14 themselves are microwave transparent, absorbing or reflective does not determine whether the thruster will work. Depending on the relative proportion of channels 14 and block substrate 32 the conductivity of the hydrogen gas may be able to make a difference to the way the microwaves propagate. In the case, however, that a susceptor absorber is used as shown in FIG. 2 the microwave absorbing surface is flat and will not rely on microwave propagation through the propellant.

The focusing mechanism for the earth bound microwave source 20 is arranged and configured to provide an effectively variable aperture size and tracking system to concentrate the transmitted energy onto the absorbing surfaces of heat exchanger 12. An earth-based source 20 of microwave energy, particularly at higher microwave frequencies in the range of 100–250 GHz is well known in the art and is described in the two Benford articles referenced above. The microwave source 20 in the illustrated embodiment is one or more phased arrays. Tracking can be either open or closed loop. A closed loop system uses returned data and/or reflected microwaves to electronically and/or mechanically steer or aim the microwave array 20 and adjust its power levels. An open loop system uses lidar or radar or a similar subsystem to track the vehicle 10 and provide steering or aiming information for the array 20. Phased arrays 20 have themselves been used as military radars for about 40 years.

The invention includes as an alternative embodiment, a low frequency system of less than 35 GHz which uses a phased array of monolithic microwave integrated circuits (MMICs) instead of the more conventional microwave power sources such as magnetrons or klystrons. At present MMICs are quite low power, but are cheaply mass produced and provide an attractive alternative as array elements.

Again, this approach has recently been adopted for use in military phased-array radars. At frequencies greater than 35 GHz the power of MMICs drops off by orders of magnitude due to the difficulty of fabricating high power chips at shorter wavelengths, requiring higher manufacturing tolerances. In the future, it is possible that this limit will be overcome via quasi-optical power combining techniques, in which case MMICs may be attractive as array elements at higher frequencies also.

More than one phased array 20 may be used for two reasons: First, to provide power to the vehicle 10 over a longer downrange distance, allowing a less extreme acceleration (e.g. manned launch). Second, to overcome microwave breakdown limits; the atmosphere most easily breaks down into a plasma in the 10–40 km region, depending on frequency as is well known in the art. By using multiple beams, higher power can be supplied to a vehicle 10 above this 10–40 km region than is possible with a single beam, thereby enabling a higher payload fraction for a heavy launcher.

In the case where the thruster 10 is space bound, the source 20 of microwave energy includes solar panels, fission, or fusion sources, powering conventional power conversion circuitry and microwave generators.

The propulsion system generalizes to use in space, for example in transportation applications requiring both high thrust and high specific impulse (e.g. a manned mars mission). Chemical rockets provide high thrust but low specific impulse, and ion engines/electric propulsion systems in general provide high specific impulse but low thrust. The microwave thermal method provides the best of both worlds, namely high thrust and high specific impulse. In this case the microwave source would be on-board or located at some point in space (or Earth orbit). Trajectories employing discrete 'burns', such as interplanetary Hohmann transfers, would only need a transmitting array 20 large enough to focus on the vehicle 10 during the initial or terminating burns, at the departure point or destination. Small trajectory corrections in the intermediate cruise phase (out of range of the transmitting arrays 20) would be made by other means e.g. small on-board chemical or electric thrusters.

Another generalization is to use this propulsion system in missiles or missile interceptors operating throughout and outside the atmosphere. Because the acceleration of this rocket is much higher than its chemical counterparts, it can out-maneuver them. In particular, a boost-phase missile intercept system could use a microwave thermal interceptor to catch up with a ballistic missile during boost phase, before it enters space or could separate with warheads and decoys. Should separation occur, the microwave beam itself can be used to help determine decoys from warheads, including by direct heating of the water or other fluids used to give dummy inflatable warheads a thermal inertia, and hence rendering them distinguishable from the real warheads by infra-red sensing.

The microwave thermal channel arrangement could be used in any industrial or scientific application requiring a very high velocity and/or high temperature jet of gas.

Several features distinguish the invention over the art. These include, but are not limited to the use of a higher microwave frequency (140 GHz) with gyrotron sources instead of magnetrons in power source 20. Atmospheric water vapor absorption usually limits microwave power frequencies to less than 35 GHz. This limit is usually reflected in almost all textbooks that present atmospheric microwave transmission as conventional wisdom. However, there are certain regions of the world, such as Maui and the Atarcarma dessert, with low atmospheric water vapor content, enabling a much higher frequency. Increasing the frequency an order of magnitude means you can decrease the diameter of the ground station an order of magnitude, and significantly raises the beam intensity at which atmospheric breakdown occurs, in effect enabling much heavier and higher payload launchers than otherwise possible. Sites suitable for high frequency microwave transmission in the range 100–200 GHz or more are the same sites suitable for millimeter wave astronomy. Therefore, present millimeter wave observatories and site surveys for new ones indicate locations suitable for high frequency microwave launch in the US and throughout the world.

In the illustrated embodiment using a susceptor absorber of FIG. 2 microwave heat exchange occurs via hydrogen channels 14 through a surface only a few cm thick located on the underside of a vehicle 10. The use of a thin refractory metal susceptor layer deposited on the inside of the hydrogen channels 14 as shown in FIG. 2, instead of or as well as a lossy dielectric block is a new approach and leads to several advantages. The surface may be vapor deposited, or possess some vapor deposited or electroplated layers. Having a thruster comprised of a thin surface is quite contrary to the usual form of a thruster, saves weight, could double as a heat shield, and is ideally suited to application on the underside of a lifting body aeroshell as shown in FIG. 3.

It must be understood that other propellants could be used, for example ammonia, while not possessing a specific impulse as high as $H_2$ for the same reservoir temperature, can be stored at a higher density, thereby reducing the volume of the launcher, and hence atmospheric drag. In general, the optimal choice of propellant will depend on the type of mission or trajectory required.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the invention.

We claim:

1. A thruster for a vehicle comprising: a source of propellant; a source of microwave energy at or above approximately 35 GHz; a heat exchanger for receiving energy from the source of microwave energy and coupled to the source of propellant to heat the propellant to create an expanding medium; and a thrust converter coupled to the heat exchanger to generate thrust from the expanding medium.

2. The thruster of claim 1 where the source of propellant comprises a source of hydrogen gas under pressure.

3. The thruster of claim 1 where the source of propellant comprises ambient atmosphere.

4. The thruster of claim 1 where source of microwave energy is at or above approximately 140 GHz.

5. The thruster of claim 1 where the source of propellant comprises ambient atmosphere and a combustible material, which is combusted with the ambient atmosphere to release additional energy added to that from the source of microwave energy and delivered to the thrust converter.

6. The thruster of claim 1 where the heat exchanger comprises a microwave absorber thermally coupled with the propellant supplied from the source of propellant and electromagnetically coupled to the source of microwave energy.

7. The thruster of claim 6 where the microwave absorber comprises a lossy dielectric block having a plurality of propellant channels defined therethrough.

8. The thruster of claim 6 where the microwave absorber comprises a susceptor.

9. The thruster of claim 8 where the susceptor comprises a sheet having a layered structure in which a plurality of propellant channels are defined and in which a susceptor is embedded.

10. The thruster of claim 9 where the layered structure comprises a susceptor layer disposed about the plurality of propellant channels and in intimate heat exchanging relationship with propellant flowing through the plurality of propellant channels, a dielectric layer disposed on each side of the susceptor layer, and a reflector layer adjacent the dielectric layer on the side opposite the dielectric layer providing a microwave exposure surface, the dielectric, susceptor and reflector layers chosen in material properties and dimensions to maximize power absorption fraction of the susceptor layer.

11. The thruster of claim 11 further comprising an aeroshell for the vehicle and where the thruster forms part of the aeroshell.

12. The thruster of claim 11 where the microwave thruster acts as part of an atmospheric re-entry heat shield.

13. The thruster of claim 12 further comprising a source of cooling fluid coupled to the thruster and where a fluid is selectively passed through the heat exchanger to cool the overall structure.

14. The thruster of claim 8 where the susceptor is comprised of at least one layer having an electroplated surface.

15. The thruster of claim 14 where the susceptor is comprised of a plurality of susceptor layers, which are clad with one or more dielectric and reflecting layers, and where at least one of the susceptor, dielectric and reflecting layers are vapor deposited.

16. The thruster of claim 7 where the thrust converter comprises a Laval nozzle.

17. The thruster of claim 8 where the thrust converter comprises a Plug nozzle.

18. The thruster of claim 1 where the source of propellant is a source of hydrogen.

19. The thruster of claim 1 where the source of propellant is a source of ammonia.

* * * * *